US007866063B2

(12) United States Patent
Caine et al.

(10) Patent No.: US 7,866,063 B2
(45) Date of Patent: Jan. 11, 2011

(54) ARTICLE OF FOOTWEAR WITH SHOCK ABSORBING HEEL SYSTEM

(75) Inventors: Andrew Caine, Portland, OR (US); Emily B. Dennison, Portland, OR (US); Fred G. Fagergren, Hillsboro, OR (US); Mihwa Hong, Busan (KR); Scott Portzline, Portland, OR (US); Blake Rhulen, Portland, OR (US)

(73) Assignee: Nike, Inc., Beaverton, OR (US)

( * ) Notice: Subject to any disclaimer, the term of this patent is extended or adjusted under 35 U.S.C. 154(b) by 805 days.

(21) Appl. No.: 11/763,415

(22) Filed: Jun. 14, 2007

(65) Prior Publication Data

US 2008/0307676 A1 Dec. 18, 2008

(51) Int. Cl.
*A43B 13/18* (2006.01)
*A43B 5/00* (2006.01)

(52) U.S. Cl. ..... 36/28; 36/27; 36/35 R; 36/37; 36/114

(58) Field of Classification Search ..... 36/28, 36/27, 35 R, 37, 38, 114, 129, 134, 7.8, 67 R; D2/964, 972
See application file for complete search history.

(56) References Cited

U.S. PATENT DOCUMENTS

| | | | | | |
|---|---|---|---|---|---|
| D65,273 | S | * | 7/1924 | Hill | D2/966 |
| D115,227 | S | * | 6/1939 | Ziniti | D2/939 |
| D122,607 | S | * | 9/1940 | Nutt | D2/965 |
| 5,060,401 | A | | 10/1991 | Whatley | |
| 5,279,051 | A | | 1/1994 | Whatley | |
| D344,399 | S | * | 2/1994 | Kilgore | D2/965 |
| D351,720 | S | * | 10/1994 | Kilgore | D2/967 |
| 6,401,366 | B2 | | 6/2002 | Foxen et al. | |
| 6,457,261 | B1 | * | 10/2002 | Crary | 36/27 |
| 6,487,796 | B1 | * | 12/2002 | Avar et al. | 36/28 |
| 6,568,102 | B1 | * | 5/2003 | Healy et al. | 36/28 |
| 7,100,309 | B2 | | 9/2006 | Smith et al. | |
| D553,337 | S | * | 10/2007 | Portzline | D2/964 |
| D554,340 | S | * | 11/2007 | Portzline | D2/964 |
| 2006/0021255 | A1 | | 2/2006 | Auger et al. | |
| 2006/0112592 | A1 | | 6/2006 | Leedy et al. | |

* cited by examiner

*Primary Examiner*—Jila M Mohandesi
(74) *Attorney, Agent, or Firm*—Plumsea Law Group, LLC

(57) ABSTRACT

An article of footwear with a shock absorbing heel system is disclosed. The heel system includes a lower heel plate, a set of support members, and an upper heel plate. Also, the heel system includes a heel cover configured to hide the upper heel plate from view. The lower heel plate is associated with a cantilever portion that supports the upper heel plate laterally. As force is applied to the heel system, the support members may compress slightly and the cantilever portion may lower, absorbing energy and or shocks applied by the ground.

29 Claims, 10 Drawing Sheets

ARTICLE OF FOOTWEAR WITH SHOCK ABSORBING HEEL SYSTEM

BACKGROUND OF THE INVENTION

1. Field of the Invention

The present invention relates generally to footwear, and in particular an article of footwear including support members.

2. Description of Related Art

Articles of footwear with support columns along the heel of the footwear have been previously proposed. Smith (U.S. Pat. No. 7,100,309) teaches a track shoe with a heel plate and two support columns. In the Smith design, the article of footwear includes an upper and a sole secured to the upper. The sole includes an outsole and a plurality of gripping elements extending outwards from the outsole. Smith also teaches the use of a heel plate extending from the midfoot portion of the outsole towards to the heel. The first and second support columns extend between the heel plate and the outsole in a vertical direction. The support columns of the Smith design are intended to attenuate shock and absorb energy in the event that a user tires and the heel portion of the footwear contacts the ground.

There is a need in the art for an article of footwear that includes support columns that may compress in the vertical direction and extend slightly in the horizontal direction in order to reduce shocks and absorb energy imparted to the footwear at the heel. Additionally, there is a need for an article of footwear with both a lower heel plate and an upper heel plate disposed above and below the support columns to facilitate comfort and stability.

SUMMARY OF THE INVENTION

An article of footwear including a shock absorbing heel system is disclosed. In one aspect, the invention provides an article of footwear, comprising: a heel system including a first support member; the first support member including a top side and a bottom side; the top side being associated with a first centroid and the bottom side being associated with a second centroid; and where the first centroid and the second centroid are misaligned with respect to a vertical axis.

In another aspect, the heel system includes a heel cover and an upper heel plate.

In another aspect, the heel cover is associated with the upper heel plate.

In another aspect, the heel cover includes a first peripheral portion that covers a second peripheral portion of the upper heel plate.

In another aspect, the heel system includes a cantilever portion configured to receive the heel cover and the upper heel plate.

In another aspect, the heel system is associated with a second support member that is substantially similar to the first support member.

In another aspect, the invention provides an article of footwear, comprising: a heel system and an upper; the heel system including a cantilever portion configured to receive an upper heel plate and a heel cover associated with at least one support member; and where the upper heel plate is hidden along an outer surface of the upper by the heel cover.

In another aspect, the at least one support member is configured to compress vertically and deform horizontally.

In another aspect, the heel system includes two support members configured compress vertically and deform horizontally.

In another aspect, the at least one support member includes a top side associated with a first centroid and a bottom side associated with a second centroid.

In another aspect, the first centroid and the second centroid are misaligned with respect to a vertical axis.

In another aspect, the two support members have a substantially identical shape.

In another aspect, the heel cover is flexible.

In another aspect, the invention provides an article of footwear, comprising: an outsole including a lower heel plate; the lower heel plate configured to receive a first support member and a second support member; the outsole including a cantilever portion configured to receive a heel cover and an upper heel plate; and where the movement of the upper heel plate and the heel cover are restrained in the vertical direction by the first support member and the second support member and wherein the movement of the upper heel plate and the heel cover are restrained in the horizontal direction by the cantilever portion.

In another aspect, the first support member has a top side and a bottom side.

In another aspect, the top side is associated with a first centroid.

In another aspect, the bottom side is associated with a second centroid.

In another aspect, the first centroid and the second centroid are misaligned with respect to a vertical axis.

In another aspect, the second support member has a similar size and shape as the first support member.

In another aspect, the upper heel plate is hidden by the heel cover along an outer surface of the article of footwear.

In another aspect, the lower heel plate includes at least one triangular hole.

In another aspect, the upper heel plate includes at least one rib disposed on a lower side of the upper heel plate.

In another aspect, the upper heel plate includes at least one rib disposed on an upper side of the upper heel plate.

In another aspect, the upper heel plate includes rounded protrusions.

In another aspect, the upper heel plate includes a heel wrap.

In another aspect, the upper heel plate includes at least one beam portion.

In another aspect, the invention provides An article of footwear, comprising: an upper including a rearward side; a support member disposed between the upper and a lower heel plate associated with an outsole; and wherein a rearward portion of the support member extends beyond the rearward side of the upper.

In another aspect, the upper is associated with an upper heel plate.

In another aspect, the rearward portion of the support member extends beyond a rearward edge of the upper heel plate.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

Moreover, in the figures, like reference numerals designate corresponding parts throughout the different views.

DETAILED DESCRIPTION OF THE PREFERRED EMBODIMENTS

Figure 1:
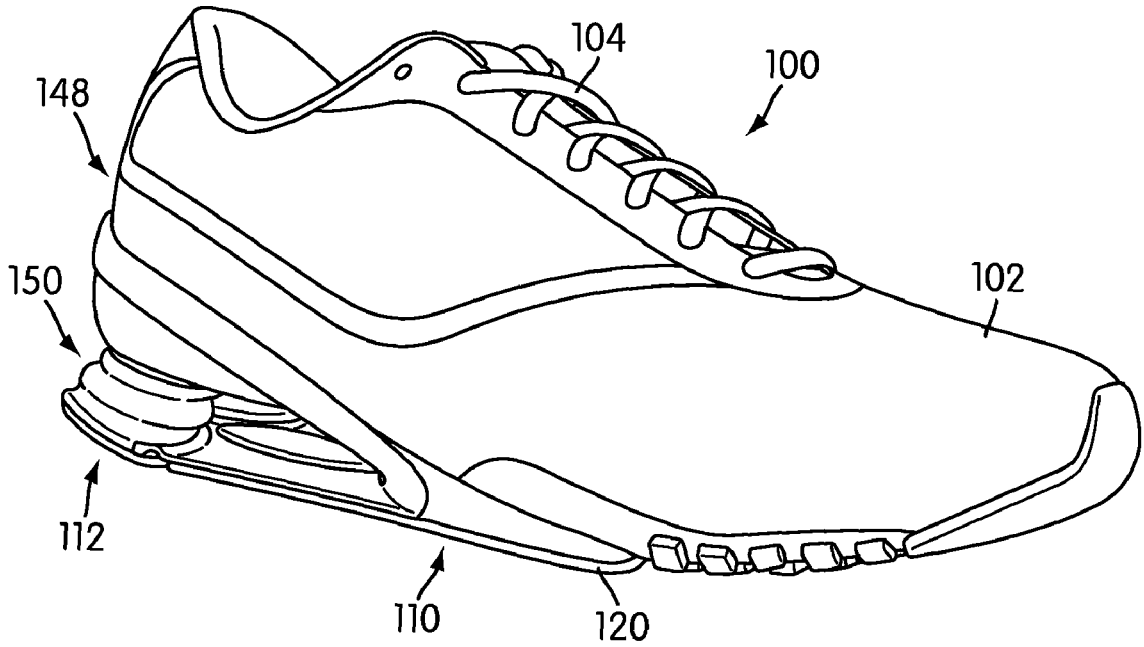
FIG. 1 is an isometric view of a preferred embodiment of an article of footwear.

FIG. 1 is an isometric view of a preferred embodiment of article of footwear 100. In a preferred embodiment, article of footwear 100 may be a running shoe. For clarity, the following detailed description discusses a preferred embodiment, however, it should be kept in mind that the present invention could also take the form of any other kind of footwear including, for example, any type of athletic shoes, boots, as well as other kinds of footwear. As shown throughout the figures, article of footwear 100 is intended to be used with a right foot, however it should be understood that the following discussion may equally apply to a mirror image of article of footwear 100 that is intended for use with a left foot.

Article of footwear 100 may include upper 102. Generally, upper 102 may be made from any material that is suitable for use as an upper. Examples of suitable materials include, but are not limited to, nylon, natural leather, synthetic leather, natural rubber, or synthetic rubber, as well as other materials. Additionally, upper 102 may include fastening system 104. In this embodiment, fastening system 104 is a pair of laces, however in other embodiments a different fastening system may be used such as straps, zippers or other types of fastening systems.

Upper 102 is preferably associated with heel system 150. Heel system 150 preferably extends from arch portion 110 of article of footwear 100 to heel portion 112 of article of footwear 100. In some embodiments, upper 102 may be attached to heel system 150. Upper 102 may be attached to heel system 150 using an adhesive, stitching, as well as other methods of attachment.

Figure 2:
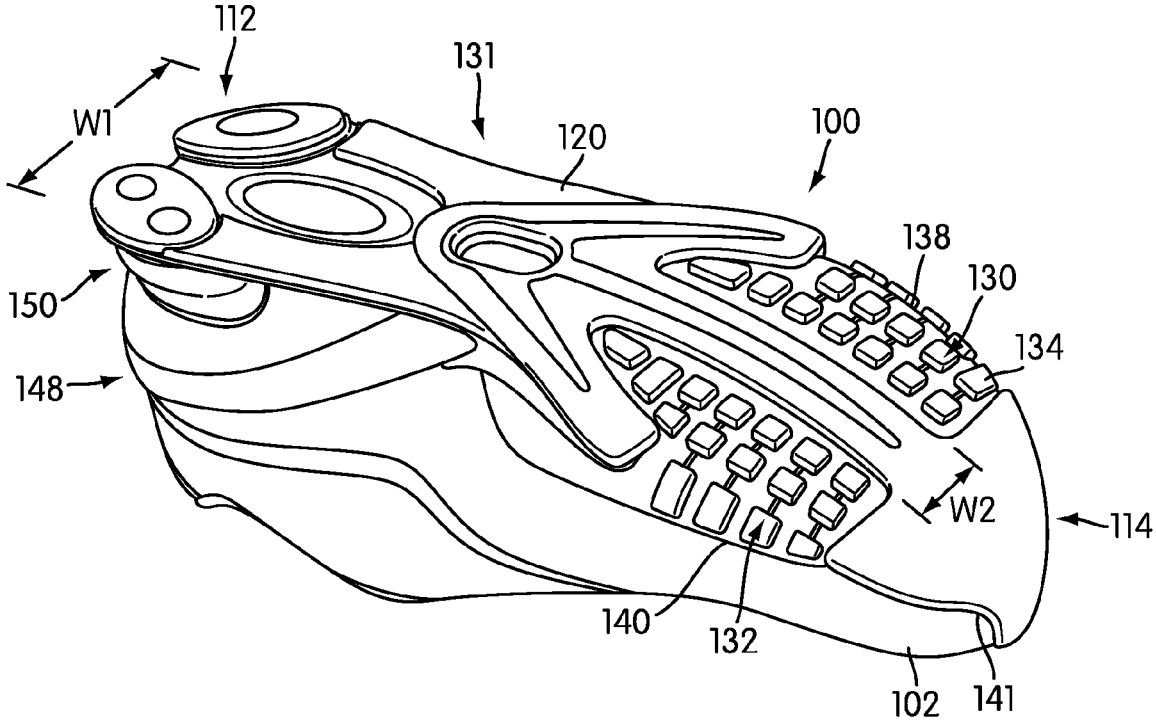
FIG. 2 is an upside down isometric view of a preferred embodiment of an article of footwear.

Referring to FIGS. 1-2, upper 102 and heel system 150 may be further associated with outsole 120. Preferably, outsole 120 is disposed on bottom side 131 of article of footwear 100, extending from forefoot portion 114 to heel portion 112. In some embodiments, outsole 120 may be configured to conform to the contour of toe portion 141 of upper 102. Furthermore, outsole 120 may be constructed with first width W1 at heel portion 112, and a second width W2 at forefoot portion 114. In this embodiment, first width W1 is greater than second width W2. This preferred configuration may give outsole 120 a somewhat unique and aesthetically pleasing appearance.

Generally, outsole 120 may be made from any suitable material. Examples of suitable materials include, but are not limited to, elastomers, siloxanes, natural rubber, other synthetic rubbers, aluminum, steel, natural leather, synthetic leather, or plastics. In a preferred embodiment, outsole 120 may be made of rubber.

In some embodiments, additional traction may be achieved between article of footwear 100 and the ground using first treaded portion 130 and second treaded portion 132. In this embodiment, first treaded portion 130 and second treaded portion 132 may be associated with upper 102. In some embodiments, treaded portions 130 and 132 may be integrally formed with upper 102. In other embodiments, treaded portions 130 and 132 may be made separately from upper 102, but attached directly to upper 102 using an adhesive. In a preferred embodiment, treaded portions 130 and 132 may be made of a durable plastic.

In a preferred embodiment, treaded portions 130 and 132 include tread elements 134. Each tread element comprising tread elements 134 may have a rectangular shape. In some embodiments, treaded portions 130 and 132 may include first peripheral portion 138 and second peripheral portion 140. Preferably, various tread elements comprising tread elements 134 may be disposed on peripheral portions 138 and 140 as well as on bottom side 131 of article of footwear 100.

Treaded portions 130 and 132, in combination with outsole 120 preferably provide the proper amount of traction between article of footwear 100 and the ground, as required by the user of article of footwear 100. In some embodiments, treaded portions 130 and 132 may facilitate increased traction in the region of a user's forefoot, and in particular, in the region of the ball of the foot. This is a useful feature, as it allows the user to plant their forefoot into the ground, while the heel is raised during running or other similar activities.

Preferably, article of footwear 100 includes provisions for supporting and absorbing energy or shocks supplied to article of footwear 100 by the ground. In some embodiments, article of footwear 100 may include a shock reducing and/or energy absorbing system. In a preferred embodiment, article of footwear 100 may include an energy absorbing system associated with a wearer's heel, as it is often preferable to reduce the shock or energy absorbed directly by a wearer's heel.

As previously discussed, article of footwear 100 may include heel system 150. Heel system 150 may be associated with heel portion 112 of outsole 120, as well as rear portion 148 of upper 102. Generally, heel system 150 may be attached directly to outsole 120 as well as rear portion 148 of upper 102. In particular, heel system 150 may be disposed between rear portion 148 and outsole 120.

Figure 3:
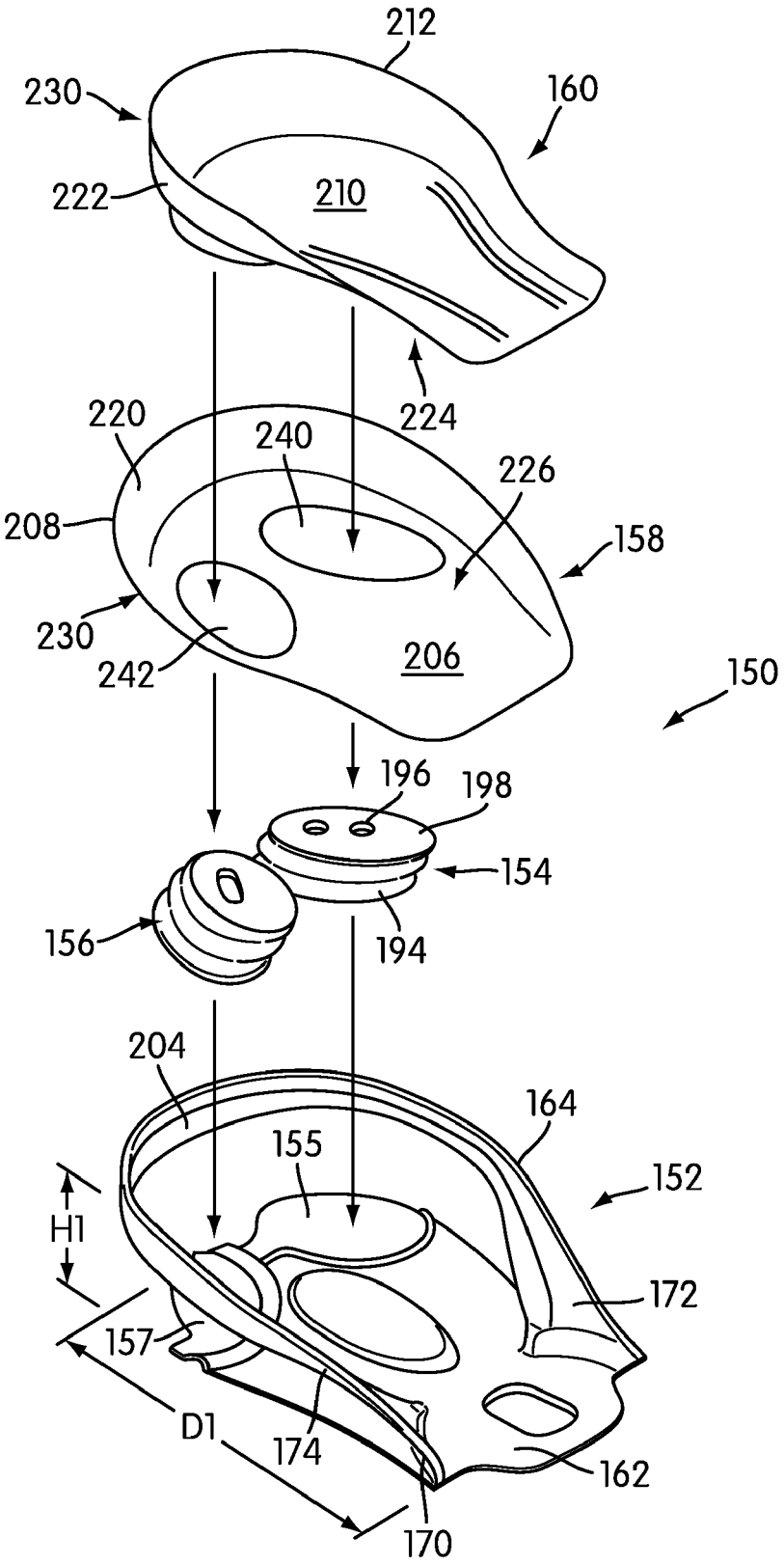
FIG. 3 is an exploded isometric view of a preferred embodiment of a heel system.

Referring to FIG. 3, heel system 150 preferably comprises heel base 152, first support member 154, second support member 156, heel cover 158 and upper heel plate 160. Generally, heel base 152 may be associated with outsole 120. Also, upper heel plate 160 may be associated with upper 102.

Preferably, heel base 152 further comprises lower heel plate 162 and cantilever portion 164. Preferably, lower heel plate 162 and cantilever portion 164 may be integrally formed. In some embodiments, cantilever portion 164 may be raised a maximum height H1 from lower heel plate 162, and extend a horizontal distance D1 from attachment region 170. Generally, H1 may be smaller than D1. This preferred cantilever arrangement provides cantilever portion 164 with some flexibility along first cantilever arm 172 and second cantilever arm 174. With this configuration, cantilever portion 164 may have some spring-like properties that may facilitate shock and/or energy absorption.

In a preferred embodiment, heel base 152, including lower heel plate 162 and cantilever portion 164 may be made of a substantially rigid plastic. In other embodiments, heel base 152 may be made of other substantially rigid materials, including, but not limited to, woven carbon fiber, glass filled nylon, Thermoplastic Polyurethane (TPU), as well as other materials. In a preferred embodiment, heel base 152 may be made of PEBAX® or Polyether block Amide.

Generally, heel base 152 may be associated with support members 154 and 156. In some embodiments, lower heel plate 162 may include first recessed portion 155 and second recessed portion 157. Recessed portions 155 and 157 are preferably configured to receive first support member 154 and second support member 156, respectively. In a preferred embodiment, support members 154 and 156 may be disposed within cantilever portion 164 once heel system 150 has been assembled.

Figure 4:
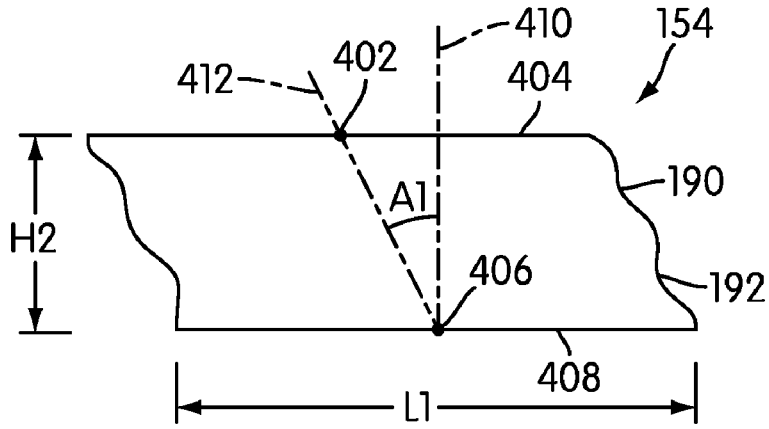
FIG. 4 is a side view of a preferred embodiment of a support member.
Figure 5:
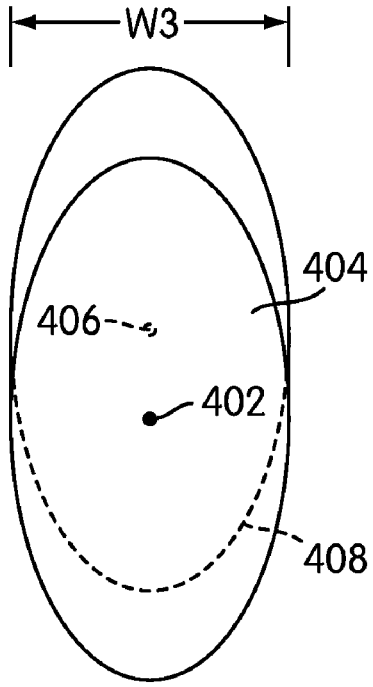
FIG. 5 is a top down view of a preferred embodiment of a support member.

Referring to FIGS. 4-5, first support member 154 generally has a column-like geometry. In particular, the column-like geometry of first support member 154 may be generally skewed cylindrical. In some embodiments, first support member 154 includes first centroid 402 associated with top side 404 and second centroid 406 associated with bottom side 408. Preferably, first centroid 402 and second centroid 406 are not aligned on vertical axis 410 that originates from second centroid 406 and is perpendicular to sides 404 and 408. Instead, diagonal axis 412 that connects first centroid 402 and second centroid 406 may form an angle A1 with vertical axis 410. In this preferred embodiment, first support member 154 is seen to have a slanted or leaning column-like shape that comprises first layer 190 and second layer 192.

In some embodiments, first support member 154 may have a height of H2. The value of height H2 may range from 1 cm to 10 cm. In a preferred embodiment, the value of H2 may be 3 cm. Also, support members 154 may be associated with length L1 and width W3. Generally, length L1 may take on any value in the range 1 cm to 7 cm. In a preferred embodiment, length L1 may have a value of 4 cm. Also, width W3 may take on any value in the range 1 cm to 7 cm. In a preferred embodiment, width W3 may have a value of 3 cm.

Generally, second support member 156 may have a similar slanted or leaning column-like geometry. In particular, the top and bottom sides of second support member 156 are preferably misaligned in a manner similar to first support member 154. In a preferred embodiment, second support member 156 also has a similar height, width and length as first support member 154.

In other embodiments, support members 154 and 156 may have features that differ from the current embodiments. In some embodiments, support members 154 and 156 may not be cylindrical, with a circular or oval base, but instead may have geometries associated with triangular, square, or other shaped bases. Additionally, support members 154 and 156 may have dimensions that differ from height H1, length L1 and width W3.

Preferably, support members 154 and 156 may be made of shock reducing and/or energy absorbing materials. Examples of such materials include, but are not limited to, rubber, elastic foams, ethyl-vinyl-acetate (EVA), phylon (EVA foam), as well as other materials. In a preferred embodiment, support members 154 and 156 may be made of polyurethane.

In some embodiments, support members 154 and 156 may include structural features that facilitate their ability to absorb energy. Referring to FIG. 3, first support member 154 may include ridges 194. Also, first support member 154 may include holes 196, with openings disposed on top surface 198. In a preferred embodiment, cavities associated with holes 196 may be oriented perpendicular to top surface 198. In other embodiments, cavities associated with holes 196 may be oriented at an angle with respect to top surface 198.

Preferably, second support member 156 may include substantially similar features. Additionally, support members 154 and 156 may include additional features that may facilitate their ability to absorb energy. Some features include additional ridges, additional holes, smooth surfaces, indentations as well as other features as disclosed in U.S. Pat. No. 7,100,309, the entirety of which is incorporated by reference.

As seen in FIG. 3, support members 154 and 156 may be associated with heel cover 158. Heel cover 158 may be configured to rest on top of support members 154 and 156. In some embodiments, heel cover 158 may be made of a flexible material such as rubber or synthetic fiber. In other embodiments, heel cover 158 may be made of leather. In a preferred embodiment, heel cover 158 may be made of a material similar to that of upper 102.

Preferably, heel cover 158 has a shape that is configured to receive upper heel plate 160. Unlike heel cover 158 that is generally soft and flexible, it may be preferable that upper heel plate 160 is made of a rigid plastic, or other similar material, since upper heel plate 160 may be disposed under a wearer's heel within article of footwear 100. In a preferred embodiment, upper heel plate 160 may be made from a similar material as heel base 152 such as PEBAX®. In other embodiments, upper heel plate 160 may be made of a different material than heel base 152, including any substantially rigid material.

As previously discussed, heel cover 158 and upper heel plate 160 preferably have a similar shape. Heel cover 158 preferably includes first base portion 206 and first peripheral portion 208. Upper heel plate 160 preferably includes second base portion 210 and second peripheral portion 212. Both first base portion 206 and second base portion 210 have a geometry that is similar to lower heel plate 162. Additionally, both first peripheral portion 208 and second peripheral portion 212 are sloped outwards from base portions 206 and 210, respectively.

In some embodiments, inner side 220 of first peripheral portion 208 may be disposed against outer side 222 of second peripheral portion 212 when heel system 150 is assembled. Also, lower side 224 of second base portion 210 may be disposed against upper side 226 of first base portion 206. This preferred arrangement allows outer surface 230 of upper heel plate 160 to be covered by heel cover 158. This may allow for additional aesthetics over a design where outer surface 230 of upper heel plate 160 may be exposed and may further serve to protect upper heel plate 160 from unnecessary wear.

In a preferred embodiment, cantilever portion 164 may be configured to receive heel cover 158 and upper heel plate 160. In some embodiments, first peripheral portion 208 of heel cover 158 may be disposed against inner surface 204 of cantilever portion 164. Preferably, heel cover 158 may include outer rim 230 that may be configured to rest along cantilever portion 164. With this preferred arrangement, heel cover 158 may be held in place above lower heel plate 162, without slipping through cantilever portion 164.

In some embodiments, heel cover 158 may include first hole 240 and second hole 242. First hole 240 and second hole 242 may be configured to receive first support member 154 and second support member 156, respectively. Using this arrangement, support members 154 and 156 may be disposed against lower side 224 of upper heel plate 160. This preferably allows direct contact between support members 154, 156 and upper heel plate 160, which may be a useful feature since heel cover 158 may not be configured to absorb energy supplied by upper heel plate 160.

In some embodiments, the various components of heel assembly 150 may be combined using glue or another type of adhesive. For instance, first support member 154 and second support member 156 may be glued to lower heel plate 162. Additionally, heel cover 158 may be glued to cantilever portion 164, while upper heel plate 160 is glued to heel cover 158. In some embodiments, support members 154 and 156 may be glued directly to upper heel plate 160. In other embodiments, these various components may be attached in other ways. Alternatively, some components may not be fastened in place. For example, upper heel plate 160 may simply sit within heel cover 158 rather than being attached to heel cover 158 using an adhesive.

Figure 6:
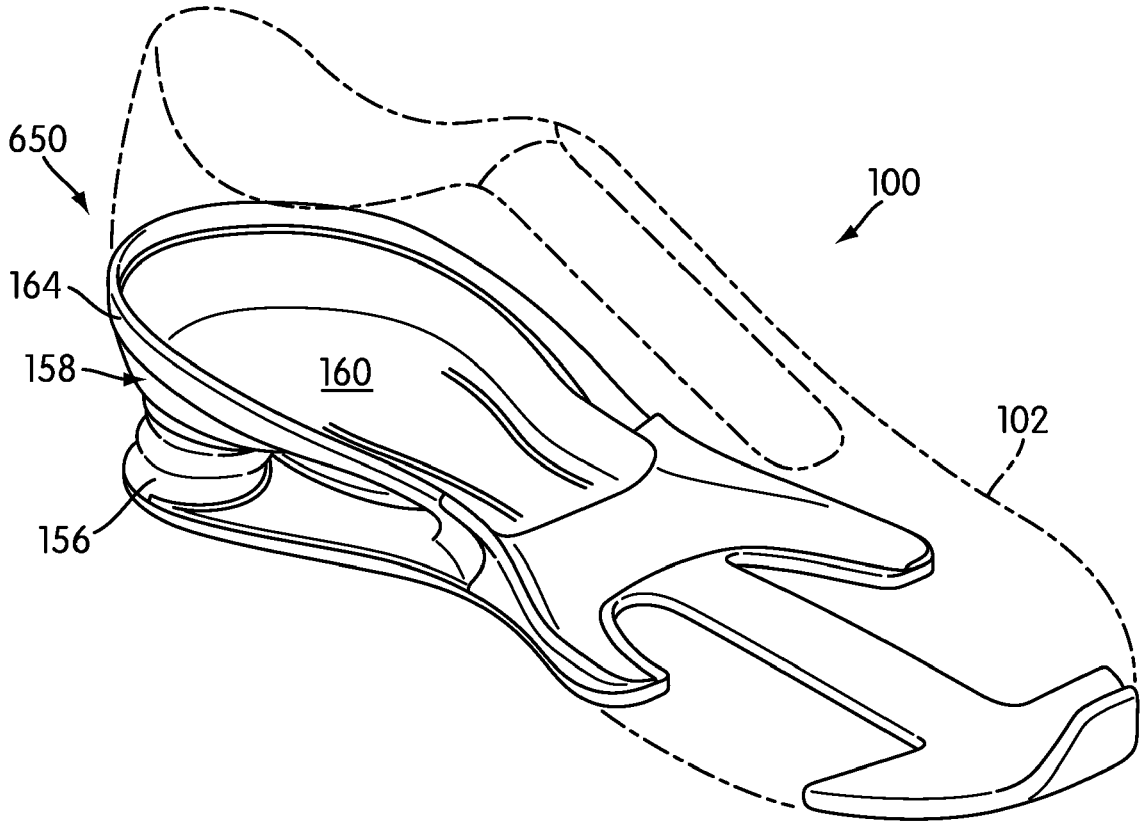
FIG. 6 is a front isometric view of a preferred embodiment of an article of footwear.

Once heel system 150 has been fully assembled, upper heel plate 160 may be supported below by support members 154 and 156, as seen in FIG. 6. Also, upper heel plate 160 may be supported laterally by cantilever portion 164. This configuration preferably reduces the tendency of upper heel plate 160 to slip within upper 102 or with respect to heel base 162.

Figure 7:
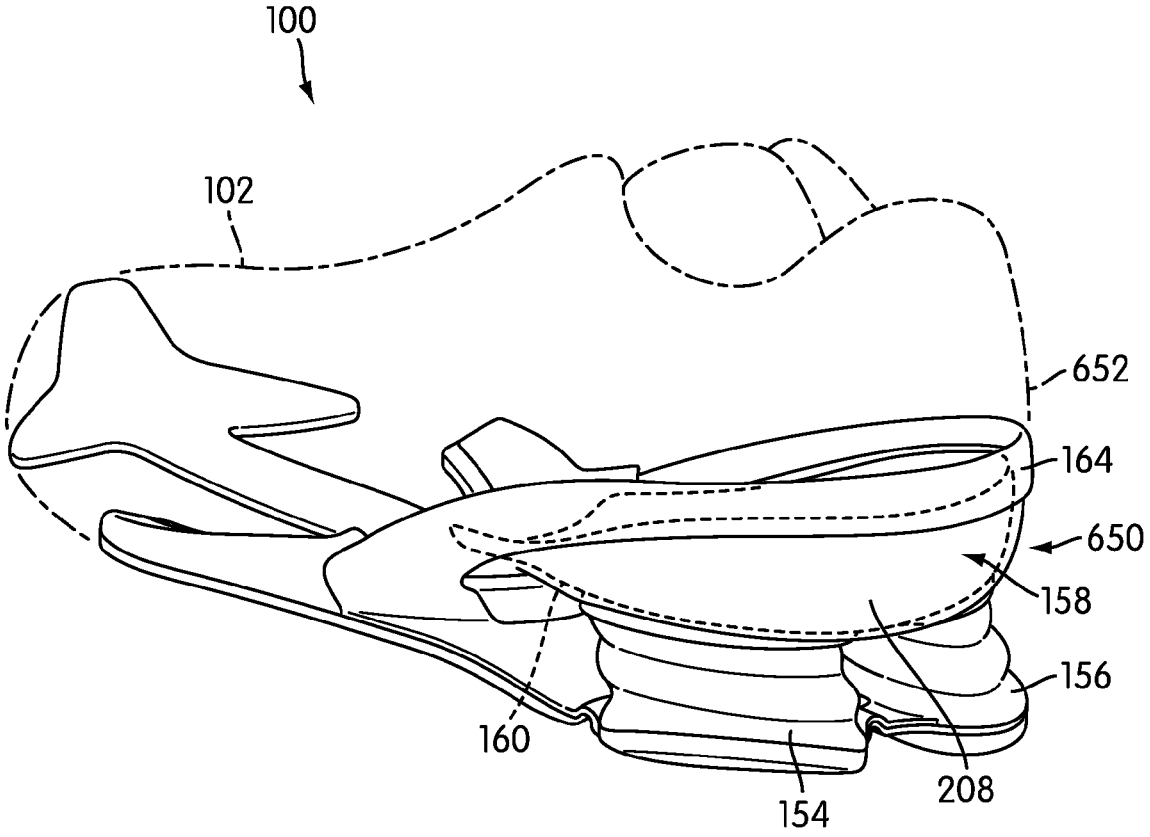
FIG. 7 is a rear isometric view of a preferred embodiment of an article of footwear.

Referring to FIGS. 6-7, upper heel plate 160 is preferably hidden by heel cover 158 and cantilever portion 164 in a manner that prevents any portion of upper heel plate 160 from being exposed along outer surface 650 of article of footwear 100. Instead, outer surface 650 comprises cantilever portion 164, first peripheral portion 208 of heel cover 158 and outer side 652 of upper 102. By using this configuration, upper heel plate 160 may be protected from exposure to elements, or other wear associated with exposed portions of article of footwear 100. Furthermore, as previously mentioned, hiding upper heel plate 160 may be a more aesthetically pleasing configuration, as heel cover 158 may more easily incorporate various textures and designs that would be difficult to apply to upper heel plate 160.

As previously discussed, heel system 150 may be configured to reduce shocks and/or absorb energy supplied by the ground to a wearer's heel. Preferably, support members 154 and 156 may be configured to deform when forces or stresses are applied to heel system 150. Also, in some embodiments, cantilever portion 164 may slightly deform under forces or stress applied to heel system 150.

Figure 8:
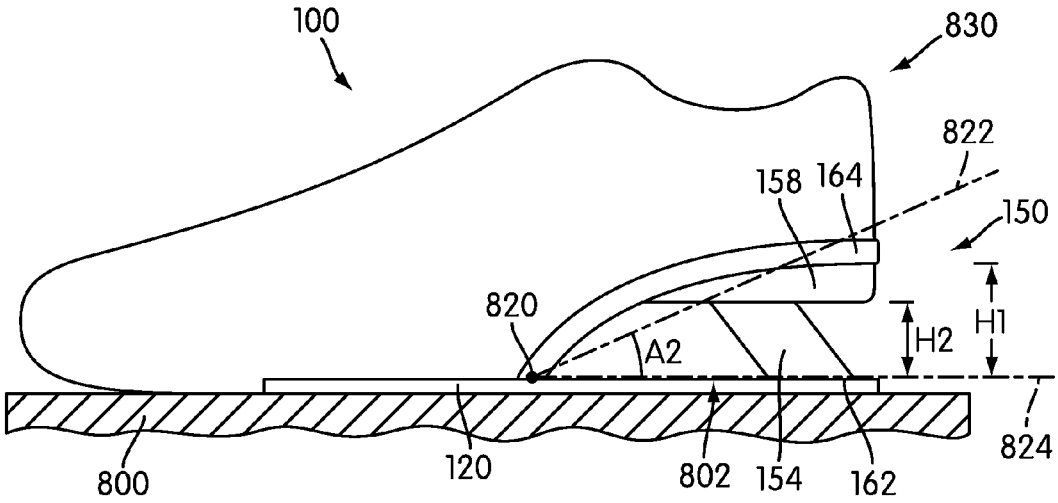
FIG. 8 is a schematic side view of a preferred embodiment of an article of footwear.
Figure 9:
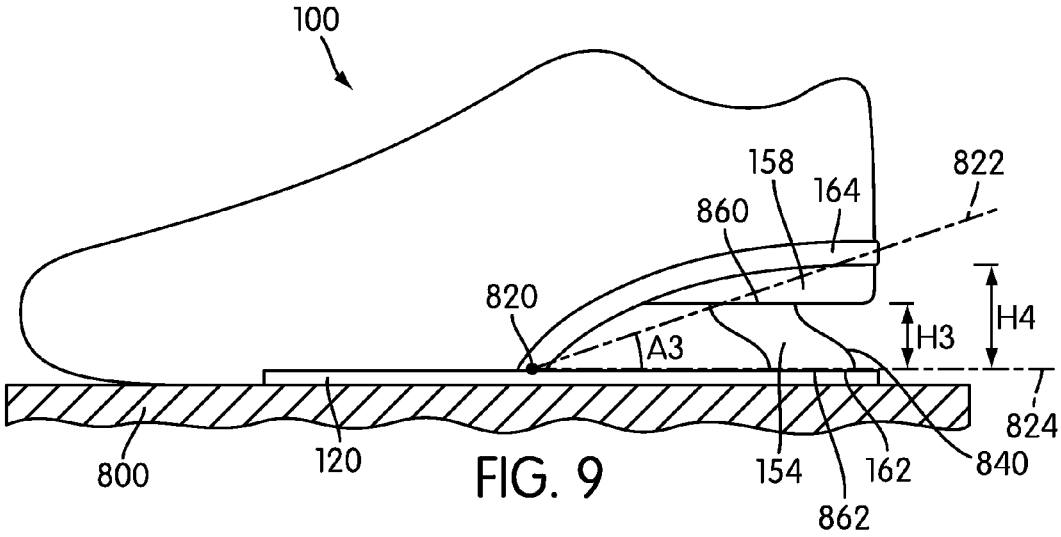
FIG. 9 is a schematic side view of a preferred embodiment of an article of footwear with a deforming heel system.

FIGS. 8-9 are intended to schematically illustrate the deformation of heel system 150 when a force is applied to article of footwear 100. In this embodiment, heel portion 802 of outsole 120 contacts surface 800. Initially, as previously discussed, first support member 154 may be associated with a height H2. Additionally, cantilever portion 164 may be a height H1 above lower heel plate 162.

Generally, the compression of heel system 150 may be approximated by considering cantilever portion 164 and lower heel plate 162 as rotating about pivot point 820. Preferably, cantilever portion 164 is approximately aligned with diagonal axis 822, while lower heel plate 162 is approximately aligned with horizontal axis 824. Initially, diagonal axis 822 makes an angle A2 with horizontal axis 824. In a preferred embodiment, first support member 154 may be fixed between heel cover 158 and lower heel plate 162, which are generally parallel.

As a force is applied downwards to heel region 830 of article of footwear 100, heel system 150 may be compressed against surface 800. In many cases, this downward force will be applied by a heel of a wearer's foot as the wearer is moving. Because heel system 150 is not rigid, heel system 150 may slightly deform under these forces. In some cases, cantilever portion 164 may bend slightly downwards, with a height H4 above lower heel plate 162 during the moment of maximum compression. In a preferred embodiment, height H4 is about 90% of height H1. Also, diagonal axis 822 may rotate slightly towards horizontal axis 824, forming an angle A3 that is smaller than angle A2.

Preferably, first support member 154 may also compress slightly. In the preferred embodiment, first support member 154 has a height H3 during the moment of maximum compression. In a preferred embodiment, height H3 is about 90% of height H2. As seen in FIG. 9, first support member 154 may deform slightly during compression, resulting in some curvature to outer surface 840 of first support member 154. The shape of first support member 154 during compression is due to the fact that upper surface 860 and lower surface 862 of first support member 154 are kept approximately parallel to horizontal axis 824 during deformation, and to the fact that surfaces 860 and 862 are not vertically aligned. Therefore, as heel system 150 is compressed, first support member 154 deforms in the manner shown in FIG. 9. This type of deformation is distinct from the type of deformation that would occur using support members that are configured as vertical columns, where the vertical columns would simply compress.

Using this preferred configuration, first support member 154 may supply additional cushioning and more flexibility over traditional vertical columns. In some cases, the use of a leaning or skewed first support member 154 may result in a softer motion as compared with traditional vertical columns. Furthermore, by varying the degree to which first support member 154 leans or is slanted with respect to the vertical direction, various deformation properties of heel system 150 may be modified, resulting in different cushioning and flexibility properties.

In FIGS. 8-9, only one side of article of footwear 100 is shown for purposes of clarity, however it should be understood that along the opposite side shown here, second support member 156 preferably undergoes similar deformations. Additionally, the slanted shape and curved deformation of first support member as shown in FIGS. 8-9 are only intended to be schematic. In some embodiments, the slanted shape and curved deformation of first support member 154 may be less obvious.

Preferably, support members 154, 156 and cantilever portion 164 are not made of permanently deforming materials. Instead, as previously discussed, support members 154, 156 and cantilever portion 164 may be made of materials with spring-like properties that provide a restoring force following an initial deformation. Therefore, once the force applied to heel system 150 has been reduced, such as when a wearer lifts their heel during walking or running, support members 154, 156 and cantilever portion 164 may be restored to their original lengths and orientations. This preferred arrangement allows for heel system 150 to re-compress and absorb shocks when the next force is applied to heel region 830.

Preferably, an article of footwear with a shock absorbing heel system includes provisions for modifying the structural characteristics of various components. In some embodiments, the rigidity of one or more components of a heel system may varied. In a preferred embodiment, the structural characteristics of a heel base, including a lower heel plate, associated with the heel system may be modified. Also, in some embodiments, the structural characteristics of an upper heel plate may be modified.

Figure 10:
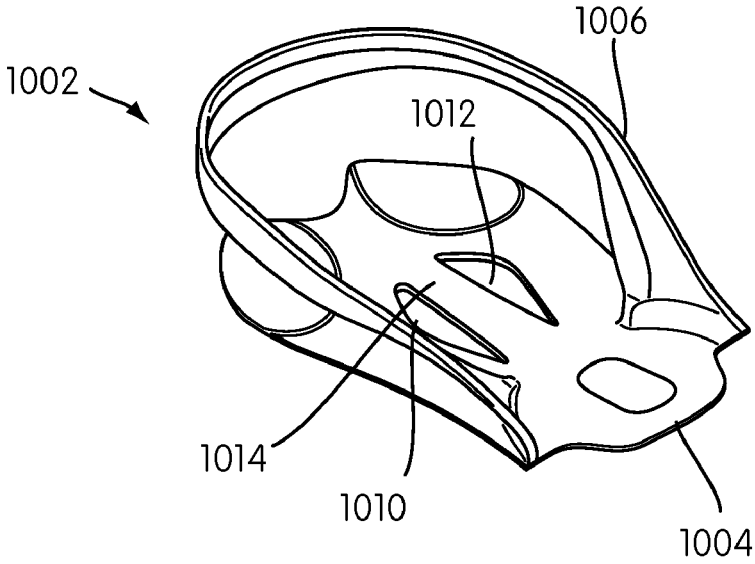
FIG. 10 is an isometric view of a preferred embodiment of a heel base.

FIG. 10 is alternative embodiment of heel base 1002. As previously discussed, heel base 1002 may include lower heel plate 1004 and cantilever portion 1006. In the previous embodiment, lower heel plate 162 (see FIG. 3) is generally solid. In this embodiment, however, lower heel plate 1004 may include first triangular hole 1010 and second triangular hole 1012. Triangular holes 1010 and 1012 may be disposed on central portion 1014 of lower heel plate 1004.

Generally, triangular holes 1010 and 1012 could be added to lower heel plate 1004 using any technique. In some embodiments, triangular holes 1010 and 1012 may be cut from lower heel plate 1004. In other embodiments, lower heel plate 1004 may be made from a mold including provisions for forming triangular holes 1010 and 1012.

Using this preferred configuration, the rigidity of lower heel plate 1004 may be modified. By adding triangular holes 1010 and 1012, the amount of material comprising lower heel plate 1004 is reduced, which may reduce the rigidity of lower heel plate 1004. This reduced rigidity may increase the 'spring-like' characteristics of lower heel plate 1004 allowing for increased shock absorbing abilities for heel system 150. Furthermore, including triangular holes 1010 and 1012 reduces the overall weight of lower heel plate 1004 that may also increase the spring-like characteristics of heel system 150.

Although two holes are shown in the current embodiment, in other embodiments it should be understood that any number of holes may be used. In some embodiments, more than two holes may be used. In still other embodiments, only one hole may be used. Additionally, the shape of the holes may vary in other embodiments. In other embodiments, the holes could be rectangular, circular, or square as well as any kind of polygon or irregular shape. By varying the number and shape of the holes, as well as the placement of the holes on lower heel plate 1004, the structural properties of lower heel plate 1004 could be modified as desired.

Figure 11:
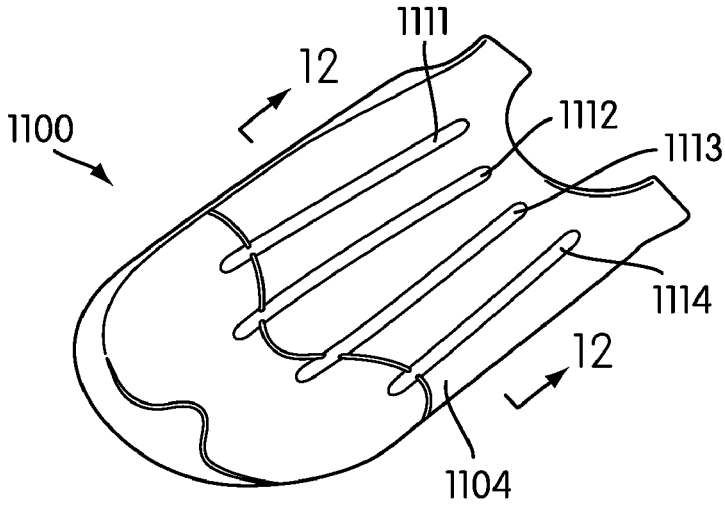
FIG. 11 is an isometric view of a preferred embodiment of an upper heel plate with ribs.
Figure 12:
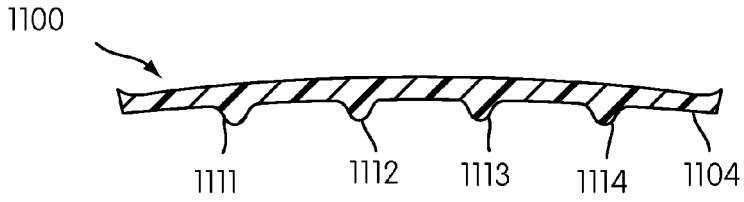
FIG. 12 is a cross sectional view of a preferred embodiment of a an upper heel plate with ribs.

Referring to FIGS. 11-12, in some embodiments the structural features of an upper heel plate could also be modified. In some embodiments, the structural properties of an upper heel plate may be modified to include ribs. In this embodiment, first upper heel plate 1100 preferably includes first rib 1111, second rib 1112, third rib 1113 and fourth rib 1114 disposed on first lower side 1104. Generally, ribs 1111-1114 are raised from first lower side 1104. In this embodiment, ribs 1111-1114 may be disposed lengthwise on first lower side 1104.

In this embodiment, ribs 1111-1114 are oriented downwards when first upper heel plate has been disposed within heel system 150 (see FIG. 3). In other words, ribs 1111-1114 may protrude away from a foot of a user and towards heel base 150 (see FIG. 3) and support members 154 and 156. The protrusion of ribs 1111-1114 is most clearly seen in FIG. 12, which is a cross sectional view of upper heel plate 1100.

In some embodiments, ribs 1111-1114 may be molded with upper heel plate 1100. In other embodiments, ribs 1111-1114 could be attached to upper heel plate 1100 after upper heel plate 1100 has been made. Preferably, ribs 1111-1114 could be attached to upper heel plate 1100 using an adhesive such as glue.

With this preferred configuration, the rigidity of upper heel plate 1100 may be modified. Using ribs 1111-1114, the section moment of inertia of upper heel plate 1100 is increased to provide increased stiffness. Although the current embodiment includes four ribs, other embodiments may include a different number of ribs. Furthermore, modifying the height of ribs 1111-1114 may also change the stiffness. Generally, increased rib height increases the overall cross sectional height of an upper heel plate that may facilitate increased stiffness. By using a different number of ribs with various heights, the stiffness and deflection properties of upper heel plate 1100 may be 'tuned' to give the desired structural characteristics to upper heel plate 1100.

Generally, the orientation of ribs 1111-1114 may also be modified to accommodate various types of motion or loading. For example, in the current embodiment ribs 1111-1114 are disposed in a lengthwise direction on upper heel plate 1100, which is a preferred configuration for motions such as running. In other embodiments, ribs 1111-1114 could be disposed in various other types of patterns, such as an 'X' pattern, an overlapping pattern or any type of non-parallel arrangement. These alternative arrangements may be configured for cutting and similar lateral motions as they provide additional lateral and longitudinal support.

Additionally, in some embodiments, ribs may be disposed locally on upper heel plate 1100, rather than over the entirety of upper heel plate 1100. In particular, ribs may be applied to one side of upper heel plate 1100 in order to provide additional support. Ribs could also be applied only to the front or rear side of upper heel plate 1100.

As previously discussed, in the current embodiment, ribs 1111-1114 protrude downwards. By using ribs that protrude below upper heel plate 1100, the foot of a user may not experience any discomfort due to ribs 1111-1114. In other embodiments, a set of ribs could also be configured to protrude upwards.

Figure 13:
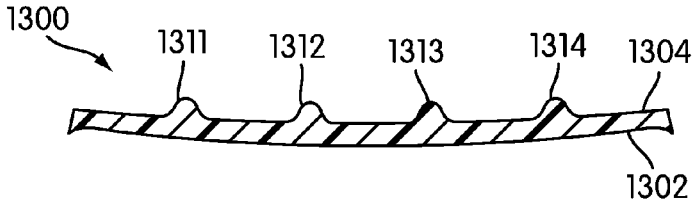
FIG. 13 is a cross sectional view of a preferred embodiment of an upper heel plate with ribs.

FIG. 13 is a cross sectional view of a preferred embodiment of upper heel plate 1300. In this embodiment, upper heel plate 1300 includes second lower side 1302 and second upper side 1304. Preferably, first rib 1311, second rib 1312, third rib 1313 and fourth rib 1314 are disposed on second upper side 1304. Adjusting the height, number and orientation of ribs 1311-1314 preferably allows for modifications to the structural characteristics of upper heel plate 1300 in a manner similar to the modifications discussed in the previous embodiment.

Additionally, in some embodiments, ribs 1311-1314 may be covered with a cushioning provision of some kind to prevent any discomfort from direct contact between the foot of a user and ribs 1311-1314. In other embodiments, the height of ribs 1311-1314 may be small enough so that no discomfort is caused from this type of contact.

In other embodiments, an upper heel plate may be associated with additional structural features to increase strength and help provide for some deflection along the length of the upper heel plate. In some embodiments, box-shaped beams could be used to modify the structural characteristics of the upper heel plate.

Figure 14:
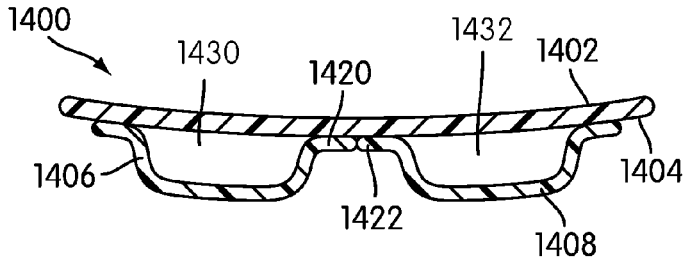
FIG. 14 is a cross sectional view of a preferred embodiment of an upper heel plate with a beam portion.

FIG. 14 is a cross sectional view of a preferred embodiment of upper heel plate 1400. Upper heel plate 1400 may include first upper side 1402 and first lower side 1404. Preferably, first lower side 1404 may be associated with first beam portion 1406 and second beam portion 1408. Although the current view is a cross section, it should be understood that first beam portion 1406 and second beam portion 1408 preferably extend lengthwise on first lower side 1404 of upper heel plate 1400.

Preferably, first beam portion 1406 and second beam portion 1408 are hollow. In particular, first beam portion 1406 may include first c-shaped channel 1430. Also, second beam portion 1408 may include second c-shaped channel 1432. These channels 1430 and 1432 preferably increase the structural integrity of beam portions 1406 and 1408, respectively.

In this embodiment, first beam portion 1406 and second beam portion 1408 may be attached directly to upper heel plate 1400. First beam portion 1406 may be attached to first lower side 1404 at first flattened ends 1420. Likewise, second beam portion 1408 may be attached to first lower side 1404 at second flattened ends 1422.

Figure 15:
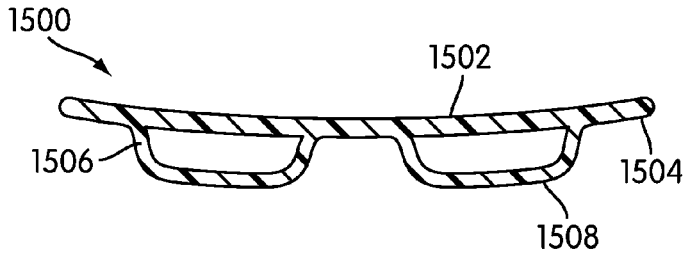
FIG. 15 is a cross sectional view of a preferred embodiment of an upper heel plate with a beam portion.

In another embodiment, shown in FIG. 15, upper heel plate 1500 may be directly attached to one or more beam portions. Upper heel plate 1500 preferably includes upper side 1502 and lower side 1504. Preferably, first beam portion 1506 and second beam portion 1508 are molded seamlessly with lower side 1504. Using a single molded piece of material for upper heel plate 1500, including beam portions 1506 and 1508, preferably increases structural integrity.

Figure 16:
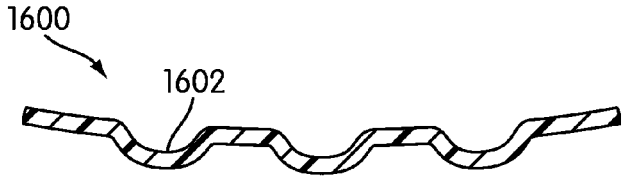
FIG. 16 is a cross sectional view of a preferred embodiment of an upper heel plate with a wavy shape.

In another embodiment, the shape of an upper heel plate could be modified to change the structural characteristics of the heel plate. Referring to FIG. 16, for example, an upper heel plate could include channel shaped offset formations. In the embodiment shown here, upper heel plate 1600 is a single piece of material that has been re-shaped or molded to include rounded portions. In particular, upper heel plate 1600 may include rounded protrusions 1602 that are configured to increase the structural integrity of upper heel plate 1600. While the current embodiment includes rounded protrusions, in other embodiments the protrusions could be square or triangular.

These rounded protrusions may preferably facilitate increased stiffness. Also, using a single piece of material allows for simplified manufacturing techniques in some cases. Additionally, a single piece of material may help reduce or substantially eliminate structural weaknesses associated with contact points between various independent components that may be attached by adhesives or similar methods.

Preferably, an upper heel plate may include provisions for partially wrapping around an ankle of a wearer. In some embodiments, the upper heel plate may include raised side walls. In a preferred embodiment, the upper heel plate may have a c-channel shape.

Figure 17:
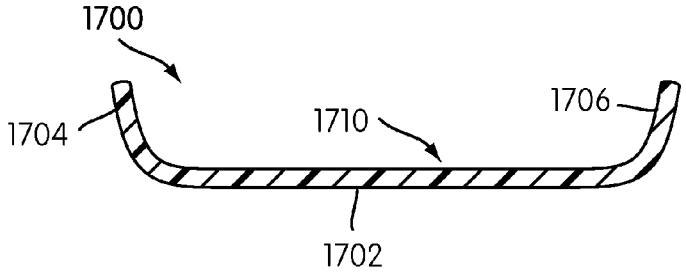
FIG. 17 is a cross sectional view of a preferred embodiment of an upper heel plate with vertical side walls.

FIG. 17 is a preferred embodiment of a cross section of upper heel plate 1700. Preferably, upper heel plate 1700 includes bottom side 1702. Upper heel plate 1700 may also include first vertical side wall 1704 and second vertical side wall 1706. First vertical side wall 1704 and second vertical side wall 1706 are preferably configured to form c-shaped channel 1710 with bottom side 1702.

This c-channel configuration may increase the strength of upper heel plate 1700. Furthermore, using this vertical side wall configuration, upper heel plate 1700 may function as a heel wrap. In particular, vertical side walls 1704 and 1706 may reduce lateral sliding of a foot with respect to upper heel plate 1700, which may help prevent injury.

In the previous embodiments, a lower heel plate was shown to include holes while an upper heel plate was seen to include ribs or other structural features. In other embodiments, a lower heel plate could also include ribs or similar structural features to those discussed with respect to an upper heel plate. Likewise, an upper heel plate could include both ribs and holes. With these various arrangements, the structural characteristics of a heel system could be 'tuned' in order to provide optimum performance according to the needs of a wearer.

In the previous embodiments, support members 154 and 156 were generally aligned with a rear side of upper 102. However, in other embodiments, support members may be configured to extend rearwards of an upper. This alternative arrangement may facilitate increased stability.

Figure 18:
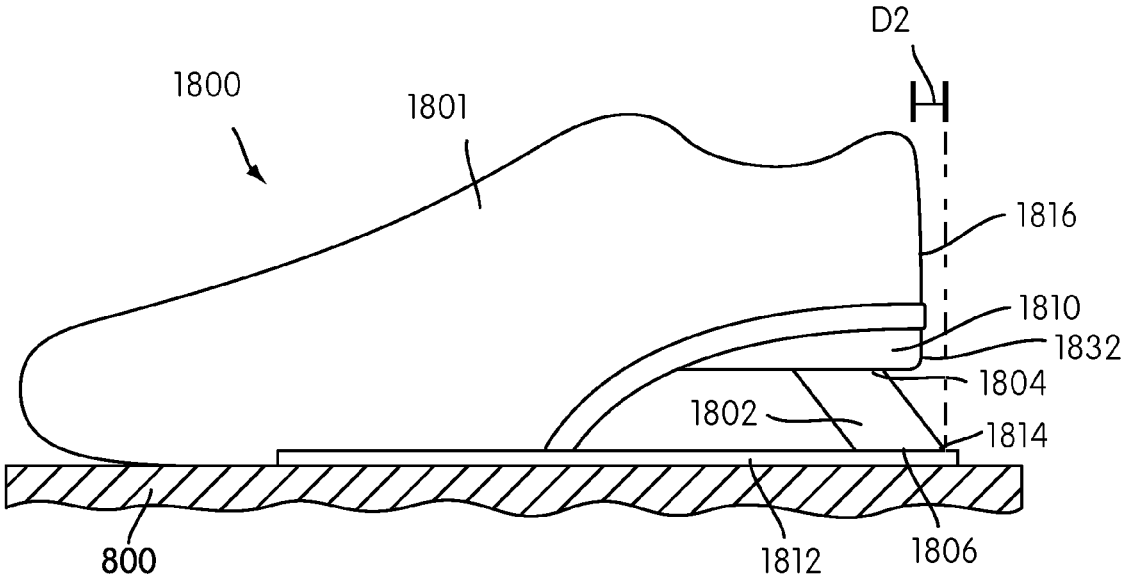
FIG. 18 is a schematic side view of a preferred embodiment of an article of footwear.
Figure 19:
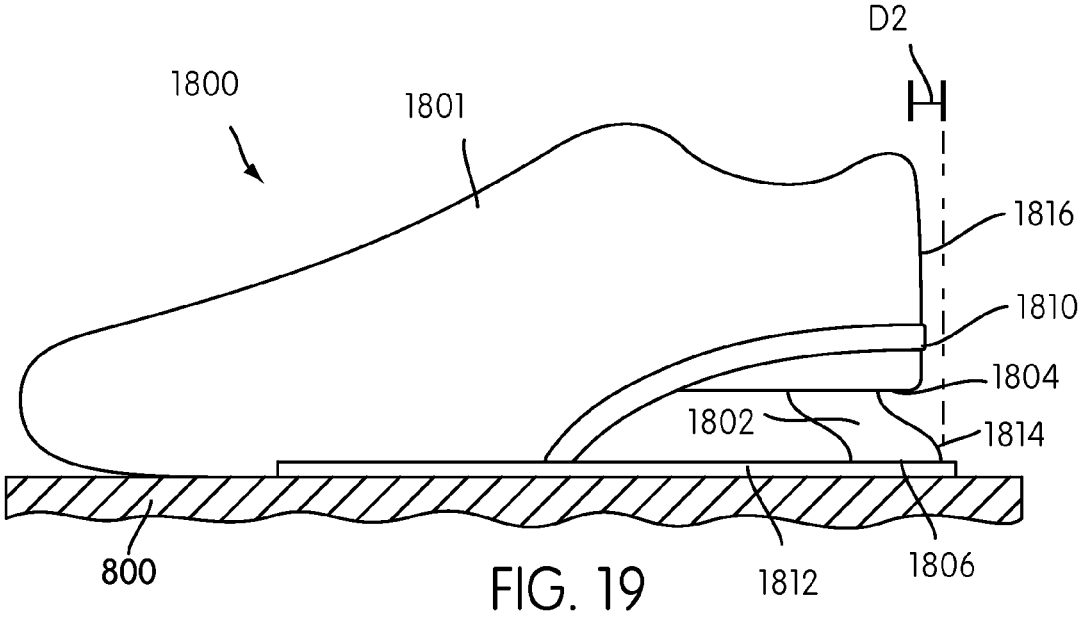
FIG. 19 is a schematic side view of a preferred embodiment of an article of footwear with a deforming heel system.

FIGS. 18 and 19 are schematic illustrations of a preferred embodiment of article of footwear 1800, including support member 1802. Preferably, support member 1802 includes top side 1804 and bottom side 1806. Top side 1804 may be disposed against upper heel plate 1810 and bottom side 1806 may be disposed against bottom plate 1812.

Preferably, in this embodiment, bottom side 1806 of support member 1802 includes rearward portion 1814. Likewise, upper 1801 preferably includes rearward side 1816. Preferably, rearward portion 1814 of support member 1802 is disposed further rearward of rearward side 1816 of upper 1801. In other words, rearward portion 1814 of support member 1802 may not be disposed below any portion of upper 1801. In the embodiment shown in FIG. 18, rearward portion 1814 extends a distance D2 beyond rearward side 1816.

Upper heel plate 1810 may include rearward edge 1832. In this preferred embodiment, rearward portion 1814 may also extend beyond rearward edge 1832. In this embodiment, rearward edge 1832 is generally coincident with rearward side 1816, however in other embodiments rearward edge 1832 may extend much further rearward than rearward side 1816.

Referring to FIG. 19, rearward portion 1814 preferably remains extended beyond rearward side 1816 during compression of support member 1802. However, in some embodiments, rearward portion 1814 does not extend beyond rearward side 1816 during compression of support member 1802. In some embodiments, like the one shown in FIG. 19, rearward portion 1814 maintains distance D2 during compression of support member 1802. However, in other embodiments, the distance D2 may change during compression of support member 1802. In some cases, distance D2 is reduced, meaning rearward portion 1814 moves closer to rearward side 1816 during compression. However, in other cases, distance D2 is increased during compression, meaning rearward portion 1814 extends further rearward during compression of support member 1802.

This arrangement, where rearward portion 1814 extends beyond rearward side 1816 may help to facilitate increased stability of article of footwear 1800. This arrangement may also help to absorb shock and pressure when the heel of the wearer strikes the ground at an angle.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a heel system including a first support member;

the first support member including a top side and a bottom side having substantially the same size and shape as the top side;

the top side being associated with a first centroid and the bottom side being associated with a second centroid; and wherein the second centroid is outwardly disposed with respect to the first centroid.

2. The article of footwear according to claim 1, wherein the heel system includes a heel cover and an upper heel plate.

3. The article of footwear according to claim 2, wherein the heel cover is associated with the upper heel plate.

4. The article of footwear according to claim 3, wherein the heel cover includes a first peripheral portion that covers a second peripheral portion of the upper heel plate.

5. The article of footwear according to claim 1, wherein the heel system includes a cantilever portion configured to receive a heel cover and an upper heel plate.

6. The article of footwear according to claim 1, wherein the heel system is associated with a second support member that is substantially similar to the first support member.

7. An article of footwear, comprising:

a heel system and an upper;

the heel system including a cantilever portion configured to receive an upper heel plate and a heel cover associated with at least one support member;

wherein the upper heel plate is hidden along an outer surface of the upper by the heel cover; and wherein the at least one support member has a slanted column-like shape and includes a top side and a bottom side having substantially the same size and shape as the top side.

8. The article of footwear according to claim 7, wherein the at least one support member is configured to compress vertically and deform horizontally.

9. The article of footwear according to claim 8, wherein the heel system includes two support members configured to compress vertically and deform horizontally.

10. The article of footwear according to claim 9, wherein the two support members have a substantially identical shape.

11. The article of footwear according to claim 7, wherein the heel cover is flexible.

12. The article of footwear of claim 7, wherein the second centroid is outwardly disposed with respect to the first centroid.

13. The article of footwear of claim 7, wherein the at least one support member is triangular.

14. An article of footwear, comprising:

an outsole including a lower heel plate;

the lower heel plate configured to receive a first support member and a second support member;

the outsole including a cantilever portion configured to receive a heel cover and an upper heel plate;

wherein the movement of the upper heel plate and the heel cover are restrained in the vertical direction by the first support member and the second support member and wherein the movement of the upper heel plate and the heel cover are restrained in the horizontal direction by the cantilever portion;

wherein the at least one support member includes a top side associated with a first centroid and a bottom side associated with a second centroid; and wherein the first centroid and the second centroid are misaligned with respect to a vertical axis.

15. The article of footwear according to claim 14, wherein the upper heel plate is hidden by the heel cover along an outer surface of the article of footwear.

16. The article of footwear according to claim 14, wherein the lower heel plate includes at least one triangular hole.

17. The article of footwear according to claim 14, wherein the upper heel plate includes at least one rib disposed on a lower side of the upper heel plate.

18. The article of footwear according to claim 17, wherein the upper heel plate includes at least one rib disposed on an upper side of the upper heel plate.

19. The article of footwear according to claim 14, wherein the upper heel plate includes rounded protrusions.

20. The article of footwear according to claim 14, wherein the upper heel plate includes a heel wrap.

21. The article of footwear according to claim 14, wherein the upper heel plate includes at least one beam portion.

22. The article of footwear of claim 14, wherein the second centroid is outwardly disposed with respect to the first centroid.

23. The article of footwear of claim 14, wherein the bottom side has substantially the same size and shape as the top side.

24. The article of footwear according to claim 14, wherein the heel system includes two support members configured to compress vertically and deform horizontally.

25. The article of footwear according to claim 24, wherein the second support member has a similar size and shape as the first support member.

26. An article of footwear, comprising:

an upper including a rearward side;

a support member disposed between the upper and a lower heel plate associated with an outsole;

the support member having a slanted column-like shape and including a top side and a bottom side having substantially the same size and shape as the top side; and wherein a rearward portion of the support member extends beyond the rearward side of the upper.

27. The article of footwear according to claim 26, wherein the movement of an upper heel plate and a heel cover are restrained in the vertical direction by the support member and wherein movement of the upper heel plate and the heel cover are restrained in the horizontal direction by a cantilever portion.

28. The article of footwear according to claim 27, wherein the rearward portion of the support member extends beyond a rearward edge of the upper heel plate.

29. The article of footwear according to claim 26, wherein the bottom side of the support member is outwardly disposed with respect to the top side of the support member.

* * * * *